US008807687B2

(12) United States Patent
Minamisawa et al.

(10) Patent No.: US 8,807,687 B2
(45) Date of Patent: Aug. 19, 2014

(54) PRINTING METHOD AND PRINTING APPARATUS

(75) Inventors: Hiroki Minamisawa, Kawasaki (JP); Hiroyuki Kakishima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 107 days.

(21) Appl. No.: 13/366,187

(22) Filed: Feb. 3, 2012

(65) Prior Publication Data

US 2012/0200629 A1 Aug. 9, 2012

(30) Foreign Application Priority Data

Feb. 8, 2011 (JP) ..... 2011-025254

(51) Int. Cl.
*B41J 29/38* (2006.01)

(52) U.S. Cl.
USPC ..... 347/16; 347/14; 347/104; 347/19

(58) Field of Classification Search
CPC ..... B41J 29/39; B41J 11/08
See application file for complete search history.

(56) References Cited

U.S. PATENT DOCUMENTS

2002/0001006 A1* 1/2002 Matsumoto et al. ..... 347/16
2008/0159800 A1* 7/2008 Wada ..... 400/621
2010/0330262 A1* 12/2010 Takeuchi et al. ..... 427/8
2011/0279508 A1* 11/2011 Naito ..... 347/16
2011/0279510 A1* 11/2011 Takeuchi et al. ..... 347/16

FOREIGN PATENT DOCUMENTS

JP 2001-239715 A 9/2001

* cited by examiner

*Primary Examiner* — Manish S Shah
*Assistant Examiner* — Jeremy Delozier
(74) *Attorney, Agent, or Firm* — Canon U.S.A., Inc., IP Division

(57) ABSTRACT

A plurality of images is sequentially printed on a sheet, and the sheet is cut at a cut position that is behind the finally-printed image. At that time, if an inappropriate region of the fed sheet that is not suited to printing is detected, and the detected inappropriate region is behind the finally-printed image, the cut position is changed to be behind the detected inappropriate region.

14 Claims, 5 Drawing Sheets

PRINTING METHOD AND PRINTING APPARATUS

BACKGROUND OF THE INVENTION

1. Field of the Invention

The present invention relates to a technique for printing a plurality of images on a sheet using a print head.

2. Description of the Related Art

In large-quantity printing such as that performed at a print lab, a roll-shape continuous sheet is used. When a roll-shape continuous sheet is produced, from the perspective of improving the production yield, the edge portions of a plurality of continuous sheets that do not meet the required length are bound to each other with a fixing material such as a splicing tape (hereinafter, "tape"). Thus, a roll-shape continuous sheet having the required length is produced. Such a roll-shape continuous sheet has a splice (connecting portion) bound by the tape at one or more random positions.

The apparatus discussed in Japanese Patent Application Laid-Open No. 2001-239715 detects a splice position by an optical sensor to detect the tape, and then performs control such that a region, including the splice, is set as a region in which printing is not allowed and is not printed on.

A splice is a region that is not suited for image printing (hereinafter referred to as an "inappropriate region"). If an inappropriate region is present immediately after a finally-printed image among a plurality of images, a cut sheet of an unused region that includes the inappropriate region will be fed back to a sheet feeding unit. Thus, during the next printing operation of a plurality of images, a sheet including the inappropriate region near the start of the sheet is fed. In some cases the state of a print head is inspected by printing an inspection pattern, which is different from a normal image, on a leading edge region of the sheet, and reading the pattern. In such a case, if the inspection pattern is formed on the inappropriate region, reading of the inspection pattern will be defective, which can prevent the inspection from being performed correctly.

SUMMARY OF THE INVENTION

An aspect of the present invention is directed to a method that can prevent a situation in which an inappropriate region is present near the start of a sheet to be fed.

According to an aspect of the present invention, a method for printing includes a first step for sequentially printing a plurality of images on a sheet to be fed, a second step for cutting the sheet at a cut position that is behind a finally-printed image among the plurality of images, a third step for detecting an inappropriate region of the fed sheet that is not suited to printing when the first step is executed, and a fourth step for changing the cut position, if the inappropriate region is detected behind the finally-printed image in the third step, to be behind the detected inappropriate region.

According to at least one exemplary embodiment, when an inappropriate region is present behind a finally-printed image among a plurality of images, the sheet is cut behind the inappropriate region and printing is finished. Consequently, a situation in which an inappropriate image is present near the start of the sheet that will be fed during the next printing can be avoided.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

An exemplary embodiment of an inkjet printing apparatus will be described below. The printing apparatus according to the present exemplary embodiment uses a continuous sheet that is wound in a roll shape. The printing apparatus is a high-speed line printing apparatus that can handle both simplex and duplex printing. For example, the printing apparatus is suited to fields in which a large quantity of sheets is printed, such as at a print lab.

Figure 1:
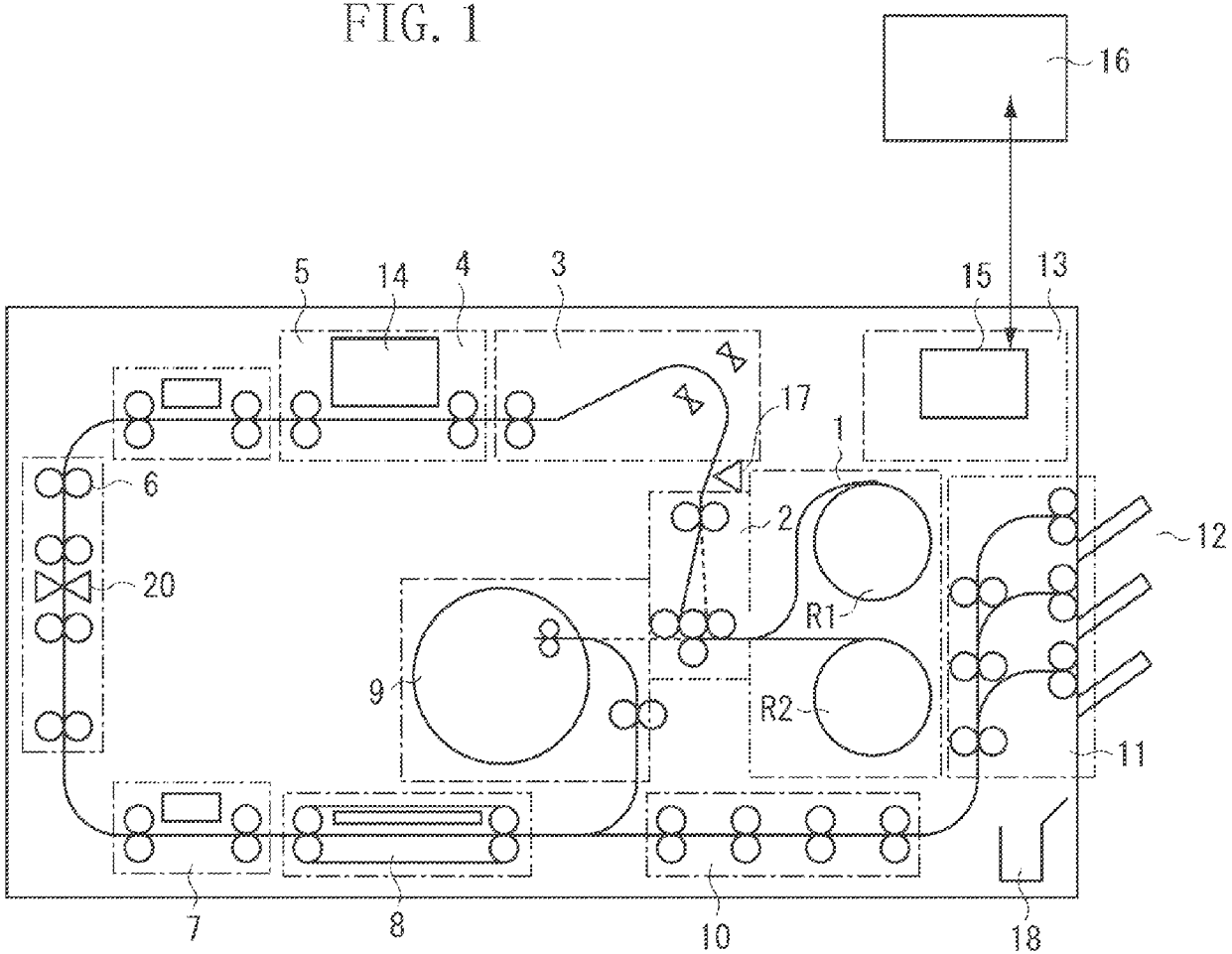
FIG. 1 is a schematic diagram illustrating an internal configuration of a printing apparatus.

FIG. 1 is a cross-sectional schematic diagram illustrating an internal configuration of a printing apparatus. The printing apparatus can print on both a first surface and a second surface of a sheet, where the second surface is on the opposite side of the first surface on the sheet.

The internal configuration of the printing apparatus includes a sheet feeding unit 1, a decurling unit 2, a skew correction unit 3, a printing unit 4, an inspection unit 5, a cutter unit 6, an information recording unit 7, a drying unit 8, a reversing unit 9, a discharge conveyance unit 10, a waste bin 18, a sorter unit 11, a discharge unit 12, and a control unit 13. The sheet is processed by the respective units while being conveyed by a conveyance mechanism configured from a pair of rollers and a belt along a sheet conveyance path as indicated by the solid line in FIG. 1. For description purposes, at an arbitrary position on the sheet conveyance path from sheet feeding until discharge, the side closer to the sheet feeding unit 1 is referred to as "upstream", and the opposite side is referred to as "downstream".

The sheet feeding unit 1 holds and feeds a continuous sheet that is wound in a roll shape. The sheet feeding unit 1 can store two rolls, a roll R1 and a roll R2, and can alternatively draw out and feed either sheet. The number of rolls that can be stored in the sheet feeding unit is not limited to two, and can be as little as one or greater than two. Further, the sheet is not limited to a sheet wound in a roll shape, as long as it is a continuous sheet. For example, a continuous sheet that is perforated every unit length and folded back onto itself at each perforation may be stored in the sheet feeding unit 1.

The decurling unit 2 reduces the curl (warp) of the sheet fed from the sheet feeding unit 1. The decurling unit 2 can reduce the curl using two pinch rollers on respective sides of one drive roller by applying a decurling force on a sheet passing through these rollers in the opposite direction of the curl.

The skew correction unit 3 corrects the skew (tilt with respect to the original conveyance direction) of a sheet that has passed through the decurling unit 2. The sheet skew is corrected by pressing a sheet edge portion of a reference side against a guide member.

The printing unit 4 is a sheet processing unit that performs printing on the conveyed sheet with a print head 14 to form an image thereon. The printing unit 4 also includes a plurality of conveyance rollers that convey the sheet.

The print head 14 includes a line type print head in which an inkjet nozzle array is formed across a range that covers the maximum width of a sheet that the printing apparatus can handle. In the print head 14, a plurality of print heads is aligned in parallel in the conveyance direction. In the present exemplary embodiment, the printing apparatus includes seven print heads corresponding to seven colors of cyan (C), magenta (M), yellow (Y), light cyan (LC), light magenta (LM), grey (G), and black (K).

The number of colors and the number of print heads are not limited to seven. The inkjet method can employ any method utilizing a heating element, a piezoelectric element, an electrostatic element, a micro-electro-mechanical system (MEMS) element, and the like. Each of the color inks is supplied to the print head 14 via a respective ink tube from an ink tank.

The inspection unit 5 determines whether an image is correctly printed by optically reading an inspection pattern or the image printed on the sheet by the printing unit 4 with a scanner, and inspecting the state of the nozzles in the print head, the sheet conveyance state, and the image position. The scanner includes a charge coupled device (CCD) image sensor or a complementary metal oxide semiconductor (CMOS) image sensor.

The cutter unit 6 includes a cutter 20 that cuts a printed sheet to a predetermined length. The cutter 20 cuts the sheet at a margin region between images formed on the sheet and behind the finally-printed image.

The information recording unit 7 records print information (unique information) such as a print serial number or the date in a non-print region of the cut sheet. The recording is performed by printing a character or a code by an inkjet method or a thermal transfer method, for example.

The drying unit 8 heats the sheet printed by the printing unit 4 to dry the applied ink in a short period of time. In the interior of the drying unit 8, the ink-applied surface is dried by hot air blown on the conveyed sheet from at least the bottom surface side. The drying method is not limited to a blowing hot air. Drying can also be performed irradiating electromagnetic waves (e.g., ultraviolet rays and infrared rays) on the sheet surface.

The above-described sheet conveyance path from the sheet feeding unit 1 to the drying unit 8 will be referred to as a "first path". The first path has a shape which forms a U-turn between the printing unit 4 and the drying unit 8. The cutter unit 6 is positioned midway along this "U" shape.

During duplex printing, the reversing unit 9 reverses the front and back surfaces of the sheet by temporarily taking up the continuous sheet after printing of the front surface has finished. The reversing unit 9 is provided midway along a path (loop path) (referred to as "second path") that goes from the drying unit 8 to the printing unit 4 via the decurling unit 2 in order to re-feed the sheet that has passed through the drying unit 8 to the printing unit 4.

The reversing unit 9 includes a winding rotary member (drum) that rotates to take up the sheet. The continuous sheet that has finished printing on the front surface but has not yet been cut is temporarily taken up onto the winding rotary member. Once take-up has finished, the winding rotary member is rotated in the reverse direction, so that the taken-up sheet is conveyed in the reverse order to that when it was taken up. Then, the sheet is fed into the decurling unit 2, and conveyed to the printing unit 4. Since the front and back surfaces of the sheet have been reversed, the printing unit 4 can print on the back surface. The operations performed in duplex printing will be described in more detail below.

The discharge conveyance unit 10 conveys the sheet that has been cut by the cutter 6 and dried by the drying unit 8, and transfers the sheet to the sorter unit 11. The discharge conveyance unit 10 is provided on a path (referred to as "third path") that is different from the second path on which the reversing unit 9 is provided. A path switching mechanism including a movable flapper is provided at a path branch position to selectively guide the sheet conveyed along the first path to either the second path or the third path.

The sorter unit 11 and the discharge unit 12 are provided at a side portion of the sheet feeding unit 1 at the end of the third path. The sorter unit 11 sorts the printed sheets into groups as necessary. The sorted sheets are discharged to the discharge unit 12 which includes a plurality of trays. Thus, the third path has a layout in which a sheet passes below the sheet feeding unit 1, and is discharged on the side opposite the printing unit 4 and the drying unit 8 across the sheet feeding unit 1.

As described above, the units from the sheet feeding unit 1 to the drying unit 8 are provided in order in the first path. After the drying unit 8, the path splits into the second path and the third path. The reversing unit 9 is provided midway along the second path. After the reversing unit 9, the second path merges with the first path. The discharge unit 12 is provided at the end of the third path.

A surface sensor 17 (detection unit) is provided between the decurling unit 2 and the skew correction unit 3. The surface sensor 17 optically detects an inappropriate region on the sheet that is not suited for image printing. On the upstream side of the printing unit 4, the surface sensor 17 optically detects from the surface of the side to be printed an inappropriate region on the sheet that is fed from the sheet feeding unit (sheet feeding unit 1 or reversing unit 9).

A representative example of an inappropriate region is a splice, which is the above-described portion that connects sheets. A continuous sheet used for printing may include one or more splices (connecting portion) which are bound by a tape or glue at random positions. The surface sensor 17 may be, for example, a reflective photosensor. The surface sensor 17 can detect a difference in surface reflectance between the sheet and the splice (tape) or a step edge of the splice tape based on changes in the amount of received reflected light. The surface sensor 17 can also be a transmissive photosensor, which detects a splice by detecting a difference in surface transmittance between the sheet and the splice.

In addition to a splice, there can be other inappropriate regions that are not suited to image printing. Examples of other inappropriate regions include scratches, folds, tears, large pieces of dirt, and smears (water based or oil based) that are partially imparted on the continuous sheet during production and which cannot be tolerated in image printing. In the present specification, these will be collectively referred to as "smears on the continuous sheet". Additional examples of inappropriate regions include a marked portion such as a symbol or a mark deliberately marked in advance on the continuous sheet. If an image is printed on these inappropriate regions, print quality substantially deteriorates, and the resultant print product is defective.

The control unit 13 controls each of the units in the whole printing apparatus. The control unit 13 includes a central processing unit (CPU), a storage device, a controller that includes various control units, an external interface, and an operation unit 15 that allows the user to perform inputs and outputs. The operation of the printing apparatus is controlled based on commands from the controller or a host apparatus 16, such as a host computer, that is connected to the controller via the external interface.

Figure 2:
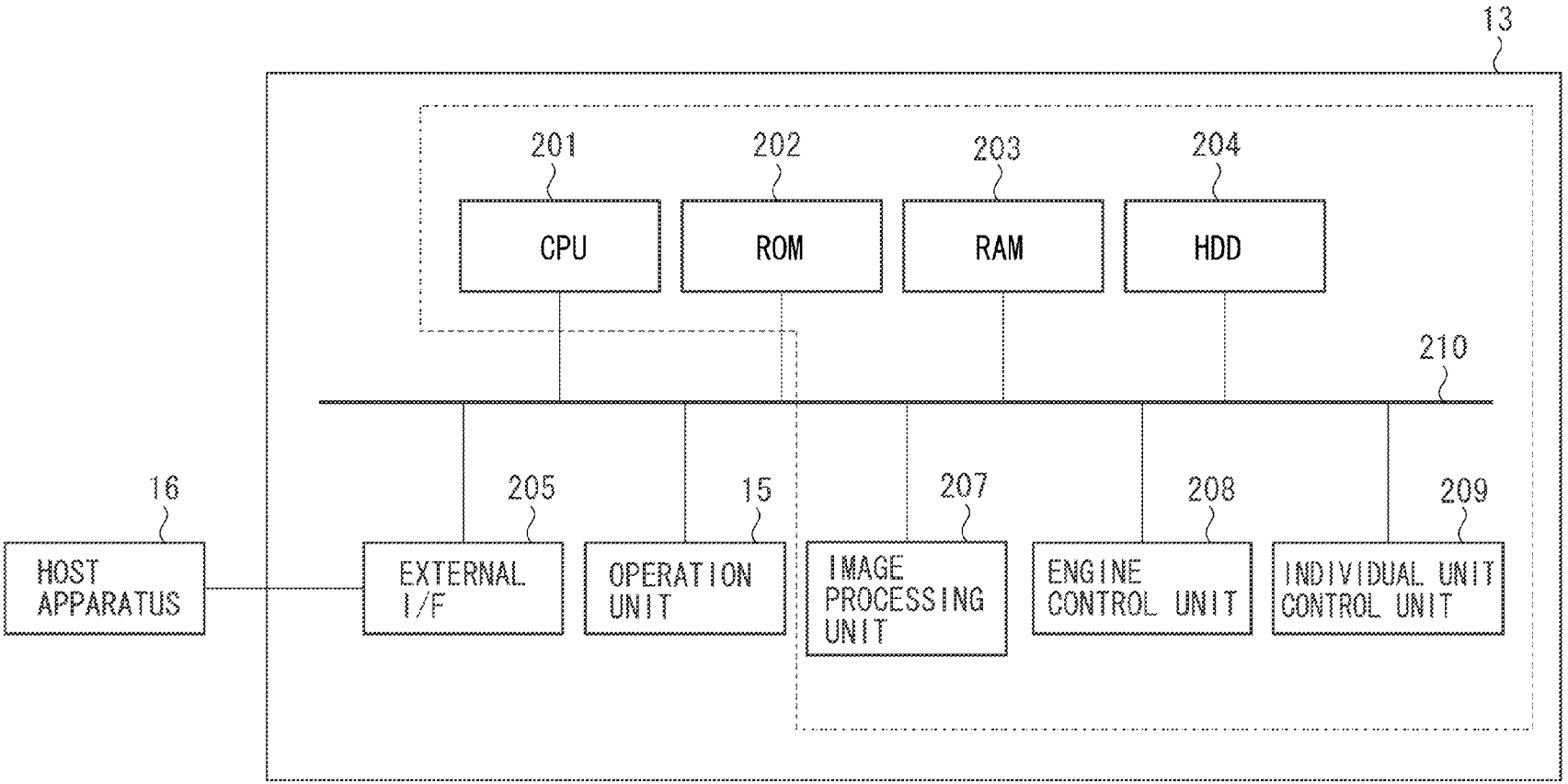
FIG. 2 is a block diagram of a control unit.

FIG. 2 is a block diagram illustrating the general idea of the control unit 13. The controller included in the control unit 13 (area enclosed by the dashed line) is configured from a CPU 201, a read-only memory (ROM) 202, a random access memory (RAM) 203, a hard disk drive (HDD) 204, an image processing unit 207, an engine control unit 208, and an individual unit control unit 209.

The CPU 201 controls the operations of the respective units in the printing apparatus in an integrated manner. The ROM 202 stores programs to be executed by the CPU 201 and fixed data required for the various operations of the printing apparatus. The RAM 203 is used as a work area for the CPU 201 and as a temporary storage area for various pieces of received data. The RAM 203 also stores various setting data pieces.

The HDD 204 can store and read programs to be executed by the CPU 201, print data, and the setting information required for the various operations performed by the printing apparatus. The operation unit 15 is an input/output interface with the user. The operation unit 15 includes an input unit, such as a hard key and a touch panel, and an output unit, such as a display for indicating information and an audio generator.

A dedicated processing unit is provided for units for which high-speed data processing is required. The image processing unit 207 performs image processing on the print data handled by the printing apparatus. The image processing unit 207 converts a color space of the input image data (e.g., YCbCr color space) into a standard red-green-blue (RGB) color space (e.g., sRGB). Further, the image processing unit 207 performs various types of the image processing, such as resolution conversion, image analysis, and image correction, on the image data as necessary. The print data obtained after the image processing is stored in the RAM 203 or the HDD 204.

The engine control unit 208 performs drive control on the print head 14 in the printing unit 4 according to the print data based on a control command received from the CPU 201, for example. The engine control unit 208 also controls the conveyance mechanism of the respective units in the printing apparatus.

The individual unit control unit 209 is a sub-controller for individually controlling the sheet feeding unit 1, the decurling unit 2, the skew correction unit 3, the inspection unit 5, the cutter unit 6, the information recording unit 7, the drying unit 8, the reversing unit 9, the discharge conveyance unit 10, the sorter unit 11, and the discharge unit 12. Operations of the respective units are controlled by the individual unit control unit 209 based on a command from the CPU 201.

The external interface (I/F) 205 connects the controller to the host apparatus 16. The external I/F 205 may be a local I/F or a network I/F. The above constituent elements are connected with each other by a system bus 210.

The host apparatus 16 serves as a supply source of image data to be printed by the printing apparatus. The host apparatus 16 may be a general-purpose or a dedicated computer, or may be a dedicated image device such as an image capture device including an image reading unit, a digital camera, and a photo storage device. If the host apparatus 16 is a computer, the computer includes a storage device in which an operating system (OS), application software for generating image data, and a printer driver for the printing apparatus are installed. Not all of the above-described processing has to be realized by software. A part or all of the processing may be realized by hardware.

Next, the basic operations performed during printing will be described. Since the operations are different for a simplex printing mode and a duplex printing mode, each of these modes will be described.

In the simplex printing mode, a sheet is fed from the sheet feeding unit 1 and processed by both the decurling unit 2 and the skew correction unit 3. Then, the printing unit 4 performs printing on the front surface (first surface) of the sheet. For a long continuous sheet, the printing unit 4 sequentially prints an image (a unit image) having a predetermined unit length in the conveyance direction and forms a plurality of images side by side. During the printing, a margin region is provided between a certain image and the next image, and a cut mark is recorded by the printing unit 4 on the margin region.

The printed sheet passes through the inspection unit 5, and is cut into each unit image by the cutter 20 in the cutter unit 6. Print information is recorded as necessary on the back surface of the cut sheet by the information recording unit 7. The cut sheets are conveyed one by one to the drying unit 8 and dried. Then, the sheets pass through the discharge conveyance unit 10 and are sequentially discharged and stacked in the discharge unit 12 of the sorter unit 11.

Meanwhile, the sheet remaining on the printing unit 4 side due to cutting of the final unit image is fed back to the sheet feeding unit 1, and taken up by the roll R1 or R2. Thus, for simplex printing, the sheet is processed by passing through the first path and the third path. The sheet does not pass through the second path.

For duplex printing, a back surface (second surface) printing sequence is executed after the front surface (first surface) printing sequence. In the initial front surface printing sequence, the operations from the sheet feeding unit 1 to the inspection unit 5 are the same as those for the above-described simplex printing.

The continuous sheet is conveyed as is to the drying unit 8 without being cut at the cutter unit 6. After the ink on the front surface is dried by the drying unit 8, the sheet is guided to the path on the reversing unit 9 side (the second path), not the path on the discharge conveyance unit 10 side (the third path). The sheet in the second path is taken up onto the winding rotary member of the reversing unit 9 that rotates in a forward direction (anticlockwise direction in FIG. 1).

At the printing unit 4, when the planned front surface printing is all finished, the trailing edge of the print region of the continuous sheet is cut by the cutter unit 6. Based on the cut position, the continuous sheet on the downstream side (printed side) of the conveyance direction passes through the drying unit 8, and all of the continuous sheet is taken up by the reversing unit 9 up until its trailing edge (cut position).

Meanwhile, simultaneously with the taking-up, the continuous sheet that remains on the upstream side in the conveyance direction than the cut position (the printing unit 4 side) is fed back to the sheet feeding unit 1 and taken up by the roll R1 or R2 so that the sheet leading edge (cut position) does not remain in the decurling unit 2. Due to the back-feeding operation, a collision with the sheet that is re-fed in the following back surface printing sequence is avoided.

After the above-described front surface printing sequence, the processing switches to the back surface printing sequence. The winding rotary member in the reversing unit 9 rotates in the reverse direction (clockwise direction in FIG. 1) to that during take-up. The edge of the taken-up sheet (the sheet trailing edge during take-up becomes the sheet leading edge during feeding) is fed along the path indicated by the dashed line in FIG. 1 to the decurling unit 2.

The curl imparted by the winding rotary member is corrected by the decurling unit 2. More specifically, the decurling unit 2 is a common unit that is provided between the sheet feeding unit 1 and the printing unit 4 in the first path and between the reversing unit 9 and the printing unit 4 in the second path, which performs a decurling action on either path.

The sheet whose two sides have been reversed passes through the skew correction unit 3, is fed to the printing unit 4, and is then printed on with a unit image and a cut mark on the back surface of the sheet. The printed sheet passes through the inspection unit 5, and is cut by the cutter unit 6 into predetermined unit lengths set in advance. Since the cut sheets have been printed on both sides, recording is not performed by the information recording unit 7. The cut sheets are conveyed one by one to the drying unit 8, pass through the discharge conveyance unit 10, and are sequentially discharged and stacked in the discharge unit 12 of the sorter unit 11. Thus, in duplex printing, the sheet is processed by passing through, in order, the first path, the second path, the first path, and the third path.

Figure 3:
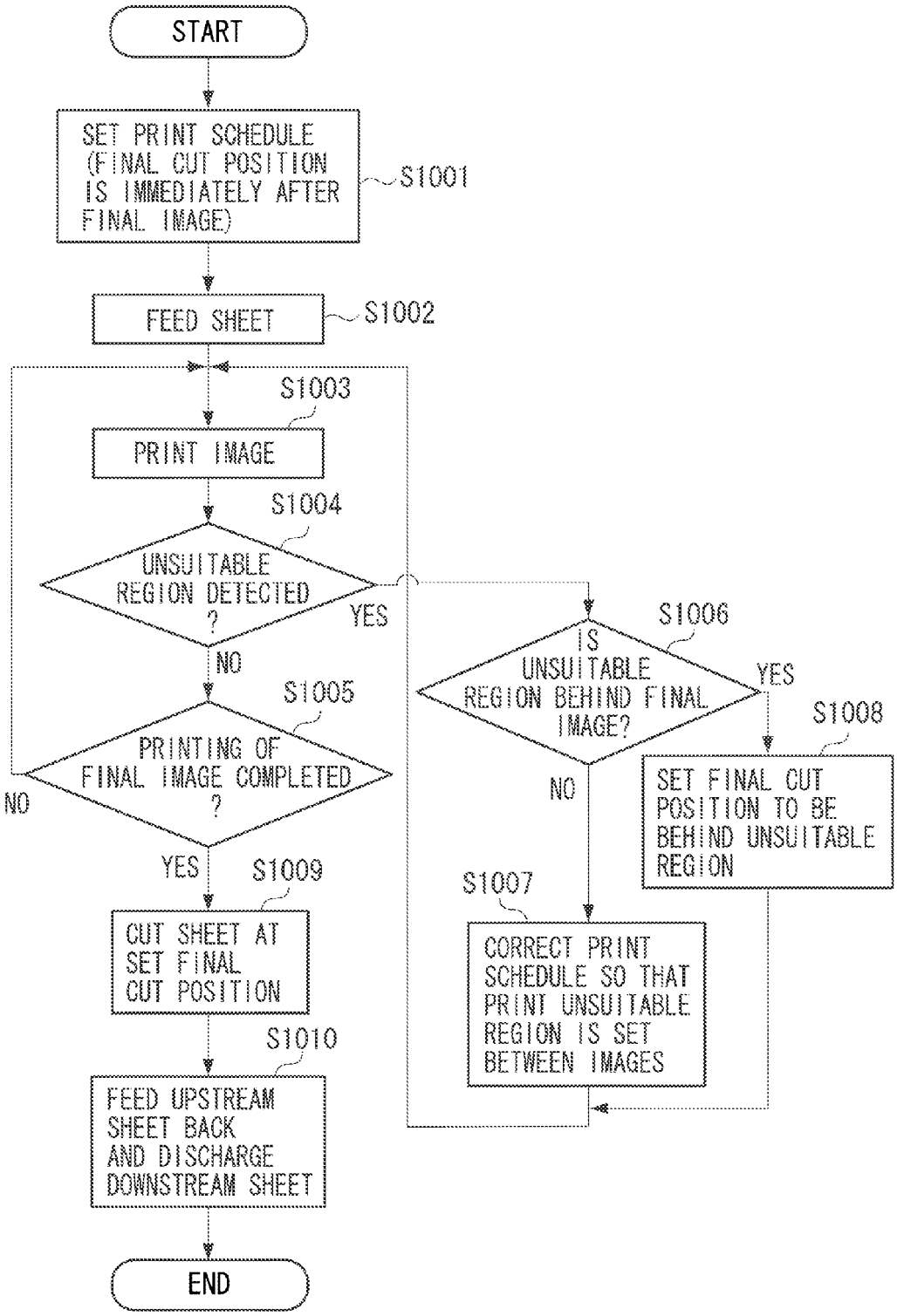
FIG. 3 is a flowchart illustrating processing performed when an inappropriate region is detected during print processing.

Next, the processing that is performed when an inappropriate region is detected during a print processing operation will be described. FIG. 3 is a flowchart illustrating the processing sequence. In step S1001, a print schedule is set. The print schedule is a collection of information pieces, such as a plurality of images included in one job, a maintenance pattern, a print order such as a margin, and a cut position of the sheet by the cutter unit. In the initial print schedule, the cut position of a sheet on which a plurality of images has been printed (referred to as a "final cut position") is the position immediately after the finally-printed image (referred to as the "final image") among the plurality of images.

Figure 4A:
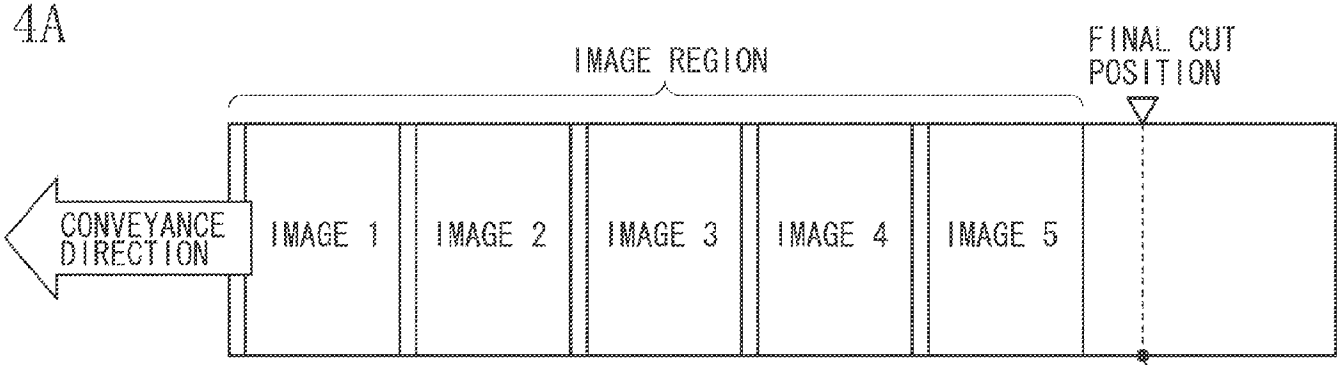
FIGS. 4A to 4C illustrate processing performed when an inappropriate region is detected.

FIG. 4A illustrates how the above-described processing is performed. Printing is performed on one surface of the sheet from an image 1 to an image 5. The final cut position is set at a position that is a predetermined distance (a first distance) away from the trailing edge of the image 5, which is the final image. A margin is provided between adjacent images. To cut off the margin as waste, the sheet is cut with either side of each margin as a cut position. The final cut position is also set immediately after the cut position of the trailing edge of image 5.

In step S1002, the sheet is fed from the sheet feeding unit (the sheet feeding unit 1 or the reversing unit 9) to the printing unit 4. In step S1003, the printing unit 4 prints images one by one on the fed sheet based on the print schedule. As described above, for the first-surface printing in the duplex printing mode, the continuous sheet is taken up by the reversing unit 9 as is without the sheet being cut for each image. On the other hand, for the second-surface printing in the duplex printing mode or in the simplex printing mode, the sheet is cut by the cutter unit 6 for each image and discharged.

In step S1004, it is checked whether the surface sensor 17 detects an inappropriate region. Since the surface sensor 17 is located further upstream on the conveyance path than the print position of the printing unit 4, the surface sensor 17 can detect prior to printing whether an inappropriate region is present in the region to be printed after the image that is being printed. If an inappropriate region is not detected (NO in step S1004), the processing proceeds to step S1005. If an inappropriate region is detected (YES in step S1004), the processing proceeds to step S1006.

In step S1005, it is determined whether printing of the final image included in the print schedule has been completed. If it is determined that printing of the final image has not been completed (NO in step S1005), the processing returns to step S1003, and the remaining images are printed. If it is determined that printing of the final image has been completed (YES in step S1005), the processing proceeds to step S1009.

In step S1006, it is determined whether the position of the detected inappropriate region is behind the region where the final image is to be printed. If it is determined that the position of the inappropriate region is not behind the region where the final image is to be printed (NO in step S1006), the processing proceeds to step S1007. If it is determined that the position of the inappropriate region is behind the region where the final image is to be printed (YES in step S1006), the processing proceeds to step S1008.

Processing in step S1007 is performed when the inappropriate region is present in the image region. In step S1007, the print schedule is corrected so as to set a region in which printing is not allowed between adjacent images.

Figure 4B:
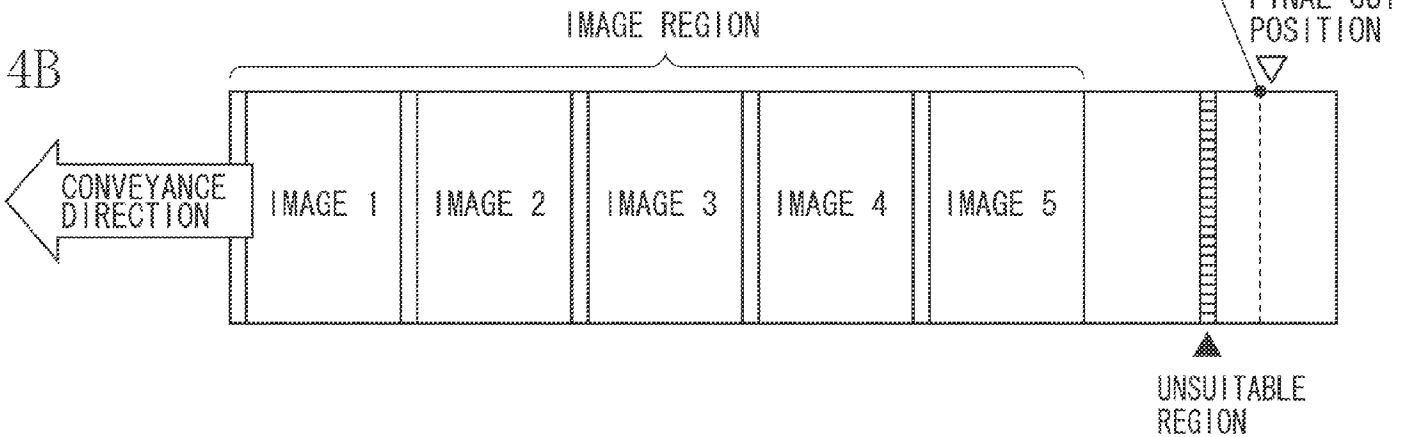
Figure 4C:
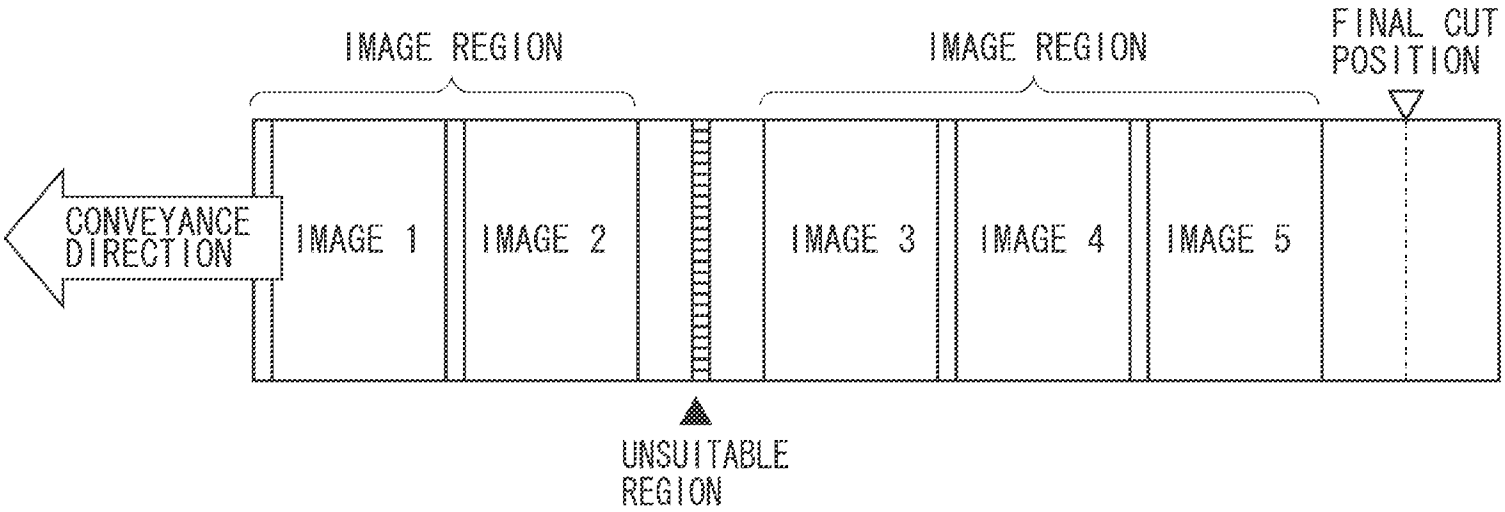

FIG. 4C illustrates how the above-described processing is performed. In the initial print schedule, the inappropriate region is present in the region where the image 3 is to be printed. If the inappropriate region is left like this, the image 3 will be defective. Therefore, the print schedule is reset so that the print position of the image 3 is behind the inappropriate region by widening an empty region (a region in which printing is not allowed) between the image 2 and the image 3 and the image 3 and the subsequent images are printed behind the empty region. Consequently, the cut position of the sheet for each image subsequent to the image 3 is also shifted backward. Same as in FIG. 4A, the final cut position is positioned at the predetermined distance (the first distance) away from the trailing edge of the image 5, which is the final image.

When the size in the sheet conveyance direction of the image 1 to the image 5 is not the same, it may be possible to reduce the size of the region in which printing is not allowed. Describing this using the example in FIG. 4C, when the region from the trailing edge of the image 2 to the inappropriate region has a sufficient distance in which a subsequent image whose size is smaller than the image 3 (e.g., the image 4) can be printed, the image print order can be rearranged so that the image 4 is inserted after the image 2. Accordingly, the quantity of sheets that are needlessly discarded is reduced, and sheet consumption can be suppressed.

Processing is step S1008 is performed when the inappropriate region is not present in the image region, rather it is present after the final image. In step S1008, the final cut position is set to be behind the detected inappropriate region. More specifically, the initially set final cut position is reset according to the distance from the trailing edge of the final image to the region where the inappropriate region is present. When the processing in step S1008 is finished, the processing returns to step S1003, and print processing continues.

FIG. 4B illustrates how the above-described processing is performed. In the initial print schedule, the inappropriate region is present further behind (upstream from) the region where the image 5, which is the final image, is to be printed. The final cut position is reset to a position that is further behind the inappropriate region by a predetermined distance. Thus, there are no problems with the printing of the images 1 to 5 that are planned for one job. However, when the region including the inappropriate region is temporarily fed back to the sheet feeding unit and the sheet is again fed for the next job, the inappropriate region appears near the sheet leading edge, so that printing will be defective. Therefore, by setting the final cut position to be behind the inappropriate region, the region including the inappropriate region is cut off and discarded, so that the inappropriate region does not appear at the start of the next job.

When the distance from the trailing edge of the final image to the detected inappropriate region is long, to facilitate discharge of the cut sheets, the cut position may be set so that the sheet is cut at a plurality of locations up to the final cut position. In this case, the final cut position does not change. When the processing in step S1008 is finished, the processing returns to step S1003, and print processing continues.

When the distance from the trailing edge of the final image to the detected inappropriate region is long, the sheet amount that is discarded without being used increases. Thus, if the distance from the trailing edge of the final image to the detected inappropriate region exceeds a predetermined range, the sheet can be cut at the initial final cut position without any change to the final cut.

As described above, if it is determined in step S1005 that printing of the final image has been completed (YES in step S1005), the processing proceeds to step S1009. In step S1009, the sheet is cut at the set final cut position.

In step S1010, of the two sheets formed as a result of the cutting at the final cut position, the upstream unused sheet is fed back to the sheet feeding unit, and the downstream sheet is discharged from the cutter unit. If the downstream sheet includes the inappropriate region, the sheet is discarded to the waste bin 18. Then, the sequence for one job is finished.

As described above, when an inappropriate region is present further behind the image to be printed, since the sheet is cut behind the inappropriate region and printing is finished, a situation in which an inappropriate region is present near the start of the sheet to be re-fed for the next printing can be avoided. For example, when the state of the print head is inspected by printing an inspection pattern on a sheet leading edge region before image printing, the inspection can be correctly performed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-025254 filed Feb. 8, 2011, which is hereby incorporated by reference herein in its entirety.

What is claimed is:

1. A method comprising:

arranging a plurality of images for sequentially printing the arranged plurality of images on a sheet which is fed in a feeding direction;

cutting the sheet at a cut position that is behind a finally-printed image from among the arranged plurality of images in the feeding direction, the cut position being determined based on a position of the finally-printed image;

detecting an inappropriate region of the fed sheet that is not suited to print;

changing the cut position based on the position of the finally-printed image, if the inappropriate region is detected behind the finally-printed image, to be behind the detected inappropriate region; and re-arranging at least one of the arranged plurality of images so as to be behind the detected inappropriate region, if the inappropriate region is detected in advance of the finally-printed image, without changing the cut position based on the position of the finally-printed image.

2. The method according to claim 1, wherein a sheet remaining on an upstream side due to the cutting is fed back to a sheet feeding unit, and a sheet remaining on a downstream side due to the cutting is discharged.

3. The method according to claim 2, wherein a sheet is cut each time each of the plurality of images is printed, and the cut sheets are sequentially discharged.

4. The method according to claim 1, wherein, if the inappropriate region is detected behind the finally-printed image and exceeds a predetermined range from a trailing edge of the finally-printed image, the sheet is not cut behind the inappropriate region.

5. The method according to claim 1, wherein, if the inappropriate region is detected in a region where the plurality of images is to be printed, a position where the image is to be printed is reset so that the image is at least not printed in the inappropriate region.

6. The method according to claim 1, wherein the inappropriate region is a splice in a sheet, a smear area on a sheet, or a marked portion that is marked in advance on a sheet.

7. The method according to claim 1, wherein the plurality of images is sequentially printed on a first surface of the sheet, and then at least one image is printed on a second surface of the sheet, which is on a side of the sheet opposite to the side of the first surface, and wherein the arranging, the cutting, the changing, and the re-arranging are executed when the plurality of images is printed on the first surface of the sheet.

8. A printing apparatus comprising:

a printing unit configured to print an image on a sheet which is fed in a feeding direction;

a detection unit configured to detect an inappropriate region of the sheet that is not suited to printing;

a cutter unit configured to cut the sheet;

an arranging unit configured to arrange a plurality of images for the printing unit to sequentially print;

a determining unit configured to determine a cut position that is behind a finally-printed image from among the arranged plurality of images in the feeding direction for causing the cutter unit to cut the sheet, the cut position being determined based on a position of the finally-printed image; and a control unit configured to control the arranging unit and the determining unit depending on a position of the inappropriate region detected by the detection unit, wherein the control unit causes the determining unit to change the cut position based on the position of the finally-printed image, if the inappropriate region is detected behind the finally-printed image, to be behind the detected inappropriate region, and wherein the control unit causes the arranging unit to re-arrange at least one of the arranged plurality of images so as to be behind the detected inappropriate region, if the inappropriate region is detected in advance of the finally-printed image, without changing the cut position based on the position of the finally-printed image.

9. The apparatus according to claim 8, wherein the control unit causes a sheet remaining on an upstream side due to the cutting to feed back to a sheet feeding unit, and causes a sheet remaining on a downstream side due to the cutting to discharge.

10. The apparatus according to claim 8, wherein the cutter unit cuts a sheet each time each of the plurality of images is printed by the printing unit, and wherein the control unit causes the cut sheets to sequentially discharge.

11. The apparatus according to claim 8, wherein the cutter unit does not cut the sheet behind the inappropriate region if the inappropriate region is detected behind the finally-printed image and exceeds a predetermined range from a trailing edge of the finally-printed image.

12. The apparatus according to claim 8, wherein the determining unit resets, if the inappropriate region is detected in a region where the plurality of images is to be printed, a position where the image is to be printed so that the image is at least not printed in the inappropriate region.

13. The apparatus according to claim 8, wherein the inappropriate region is a splice in a sheet, a smear area on a sheet, or a marked portion that is marked in advance on a sheet.

14. The apparatus according to claim 8, wherein the printing unit sequentially prints the plurality of images on a first surface of the sheet, and then prints at least one image on a second surface of the sheet, which is on a side of the sheet opposite to the side of the first surface, and wherein the control unit controls the arranging unit and the determining unit when the plurality of images is printed on the first surface of the sheet by the printing unit.

* * * * *